United States Patent [19]

James et al.

[11] Patent Number: 4,877,969

[45] Date of Patent: Oct. 31, 1989

[54] FLASKS FOR RADIOACTIVE MATERIALS

[75] Inventors: Leslie G. James, Sandiway; Michael J. Old, Antrobus, both of United Kingdom

[73] Assignee: British Nuclear Fuels Plc, Warrington, England

[21] Appl. No.: 168,234

[22] Filed: Mar. 15, 1988

[30] Foreign Application Priority Data

Apr. 6, 1987 [GB] United Kingdom ..... 8708198

[51] Int. Cl.[4] ..... G21F 5/00

[52] U.S. Cl. ..... 250/507.1; 376/272

[58] Field of Search ..... 250/506.1, 507.1, 515.1; 376/272

[56] References Cited

U.S. PATENT DOCUMENTS

| | | | |
|---|---|---|---|
| 3,466,445 | 9/1969 | Schlics | 250/507.1 |
| 4,288,699 | 9/1981 | der Vlis et al. | 250/507.1 |
| 4,414,475 | 11/1983 | Kratz et al. | 250/507.1 |
| 4,649,017 | 3/1987 | Couture | 250/507.1 |
| 4,781,883 | 11/1988 | Daugherty | 250/507.1 |
| 4,800,283 | 1/1989 | Efferding | 250/507.1 |

FOREIGN PATENT DOCUMENTS

| | | |
|---|---|---|
| 0020948 | 1/1981 | European Pat. Off. . |
| 0175140 | 3/1986 | European Pat. Off. . |
| 709156 | 2/1958 | United Kingdom . |
| 2177962 | 2/1987 | United Kingdom . |

*Primary Examiner*—Bruce C. Anderson

*Attorney, Agent, or Firm*—William R. Hinds

[57] ABSTRACT

A flask for the transport of radioactive material comprises a hollow body containing a number of substantially identical members which cooperate to define a plurality of channels to receive radioactive waste containers. Each member is shaped to define substantially a half of an outer channel and a portion of a central channel. The members, conveniently aluminium bodies, are releasably secured to and in good thermal contact with the wall of the hollow body to provide for the conduction of heat generated within the waste containers.

8 Claims, 3 Drawing Sheets

FLASKS FOR RADIOACTIVE MATERIALS

The present invention concerns a flask for the transport of radioactive material.

BACKGROUND OF THE INVENTION

A flask for the transport of high level vitrified radioactive waste operates dry under all conditions. The waste is contained in sealed containers which are housed within the flask and it is necessary to provide for thermal transfer between the containers and the flask wall in order to dissipate the heat generated by radioactive decay of the waste. It is known to provide a monolithic support structure within the flask to receive the sealed containers. Heat transfer from the waste through the support structure and into the flask wall is determined by the degree of thermal contact between the components. Due to the size and complexity of a monolithic support structure, good thermal contact is often difficult to achieve and distortion of the structure during use can make subsequent withdrawal from the flask a difficult operation.

FEATURES AND ASPECTS OF THE INVENTION

According to the present invention, a flask for the transport of radioactive material comprises a hollow cylindrical body, a plurality of substantially identical individual elongate members releasably secured within the body to define longitudinally extending channels to receive and accommodate containers for radioactive material, each member having concave longitudinally extending side surfaces which each form only a portion of a channel, another portion of which is formed by a side surface of an adjacent one of the members, and each member having a radially outer surface curved to conform to the curvature of the interior of the hollow cylindrical body whereby to maximize thermal contact therebetween for dissipation of heat generated by decay of the radioactive material.

Preferably a radially inner surface of each member defines a portion only of a central channel in the hollow body and cooperates with radially inner surfaces of the other members to define a complete central channel.

A stepped longitudinally extending groove may be formed in the radially outer surface of each member, and shaped keys fixedly secured to the inner wall of the hollow body may be provided to cooperate with the stepped grooves such that the keys slidably receive the stepped grooves. A clamping bar may cooperate with the keys to releasably secure the member to the wall of the hollow body. The keys may extend the length of the hollow body. Preferably each member is individually releasably secured to the body and is individually insertable into and removable from the body.

DESCRIPTION OF THE DRAWINGS

The invention will be described further, by way of example, with reference to the accompanying drawings; in which.

DESCRIPTION OF THE PREFERRED EMBODIMENT

Figure 1:
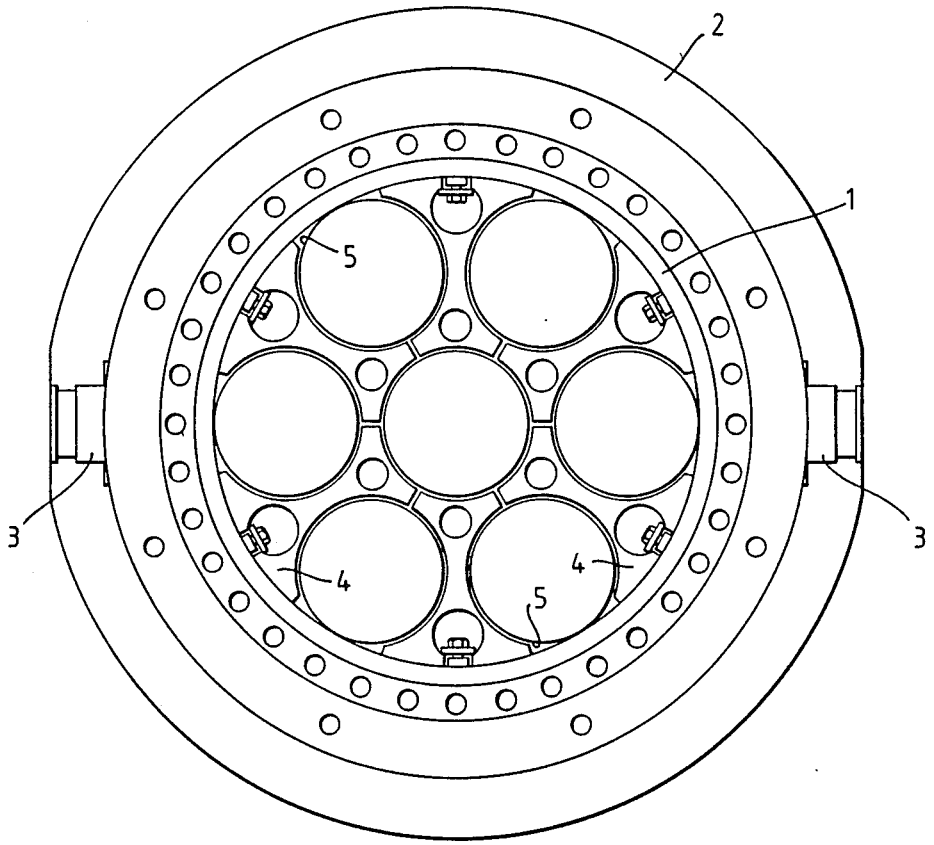
FIG. 1 is an end view of a flask for the transport of radioactive material.

With reference to FIG. 1, a transport flask for radioactive material comprises a hollow cylindrical body 1 provided with cooling fins 2 and lifting trunnions 3. In use the open end of the body is closed by a lid (not shown) which can be bolted to the body.

The interior of the body accommodates a plurality of substantially identical members 4 which cooperate to define channels 5 to receive radioactive waste containers. In the example of FIG. 1 the members 4 define seven such channels 5.

Figure 2:
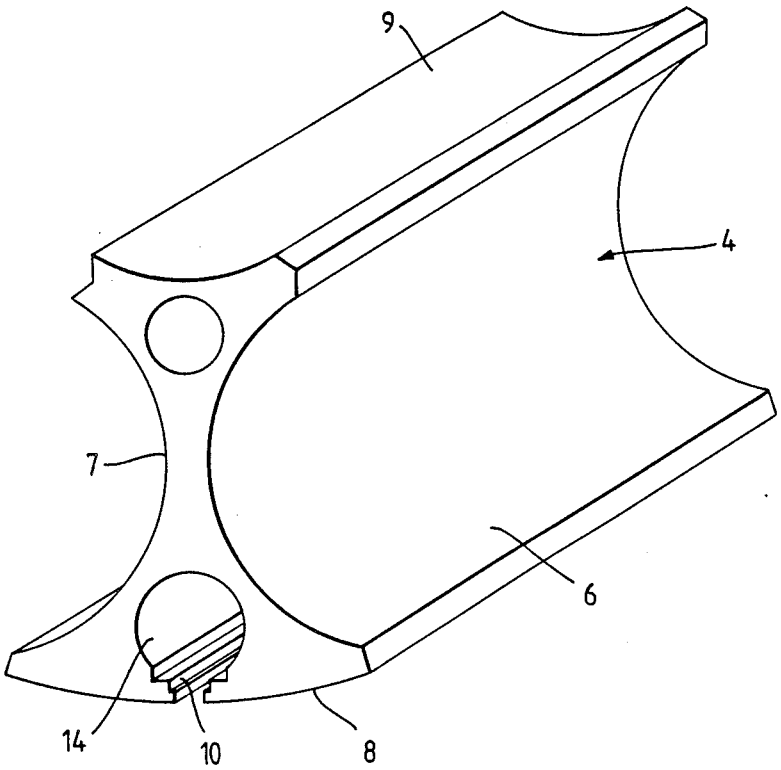
FIG. 2 is an isometric view of an internal member of the flask.
Figure 3:
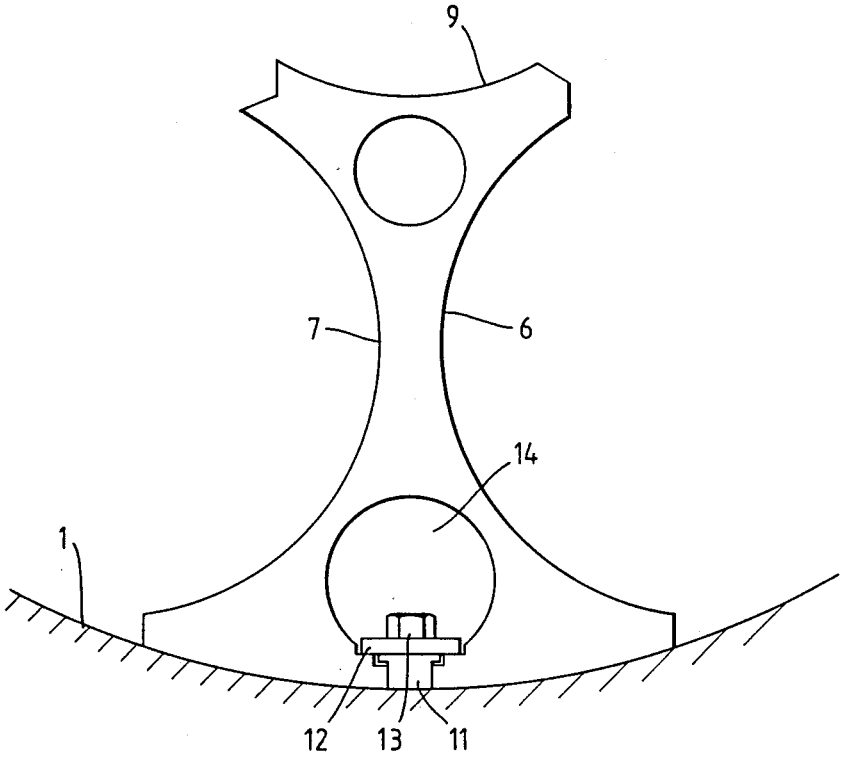
FIG. 3 is an end view of the internal member when fitted in the flask.

With reference to FIGS. 2 and 3, each member 4 comprises an elongate aluminium body having concave longitudinally extending surfaces 6 and 7 which each define substantially a half of channel 5. Radially outer surface 8 of the member is curved to conform to the curvature of the interior of the body 1. Radially inner surface 9 of the member 4 is curved to define a portion of a central channel 5. A stepped groove 10, which extends the length of the member 4 is formed in the surface 8.

A plurality of T-shaped keys 11 are fixedly secured to the flask body at regular intervals about the interior thereof, the keys 11 extending the length of the body. The keys 11 are dimensioned to slidably receive the stepped grooves in the members 4. A clamping bar 12 cooperates with each key 11 to clamp the member 4 in position, the clamping bar being secured to the T-piece by bolts 13, conveniently three in number, spaced at equal intervals along the length of the bar.

During assembly, each member 4 slides along its locating T-shaped key 11 into its required position within the flask body. The member 4 is then clamped securely to the wall of the flask body by tightening the bolts 13 to a predetermined torque. The stepped groove opens into an enlarged passage 14 which can receive a tool for applying the required torque to the bolts.

The member 4 is so shaped that initially contact is made against the flask wall at the longitudinal edges of the member. Upon tightening the bolts the member deforms elastically until contact is made along the full extent of the radially outer surface of the member. This ensures good thermal contact between the member and the flask body. The individual members 4 cooperate to define the channels 5 within the flask body. Containers containing radioactive material can be accommodated in the channels and the members 4 provide for the conduction of heat generated within the containers to the flask body.

As the structure within the flask is formed from a plurality of individual and substantially indentical separate members 4, the cost of manufacture can be less than that of a single monolithic support. The build-up of stresses or distortion is minimised as a result of the separate members. A further advantage lies in the recovery of containers which might become jammed or stuck within the channels as it is possible to remotely release the members 4 to thereby free the containers.

We claim:

1. A flask for the transport of radioactive material comprising a hollow cylindrical body, a plurality of substantially identical individual elongate members releasably secured within the body to define longitudinally extending channels to receive and accommodate containers for radioactive material, each member having concave longitudinally extending side surfaces which each form only a portion of a channel, another portion of which is formed by a said side surface of an adjacent one of said members, and each member having a radially outer surface curved to conform to the curvature of the interior of the hollow cylindrical body whereby to maximize thermal contact therebetween for dissipation of heat generated by decay of the radioactive material.

2. A flask according to claim 1 in which a radially inner surface of each member defines a portion only of a central channel in the hollow body and cooperates with radially inner surfaces of the other members to define a complete central channel.

3. A flask according to claim 2 wherein each member is individualy releasably secured to said body and is individually insertable into and removable from said body.

4. A flask according to claim 2 wherein the outer curved surface of each member is of greater circumferential extent than its radially inner surface.

5. A flask according to claim 1 in which a stepped longitudinally extending groove is formed in the radially outer surface of each member.

6. A flask according to claim 3 including shaped keys fixedly secured to the inner wall of the hollow body and cooperable with the stepped groove such that the keys slidably receive the stepped grooves.

7. A flask according to claim 6 wherein said keys extend the length of said hollow body.

8. A flask according to claim 6 including a clamping bar cooperable with the keys to releasably secure the member to the wall of the hollow body.

* * * * *